United States Patent [19]

Asano et al.

[11] 4,050,278

[45] Sept. 27, 1977

[54] APPARATUS FOR CONVEYING PRODUCTS EXTRUDED OUT OF AN EXTRUDING PRESS

[75] Inventors: Toyohide Asano; Masahiro Honda, both of Ube, Japan

[73] Assignee: Ube Industries, Ltd., Japan

[21] Appl. No.: 704,063

[22] Filed: July 9, 1976

[30] Foreign Application Priority Data

Aug. 29, 1975 Japan ..... 50-104021

[51] Int. Cl.[2] ..... B21C 35/02

[52] U.S. Cl. ..... 72/257; 72/256

[58] Field of Search ..... 72/256, 257, 302

[56] References Cited

U.S. PATENT DOCUMENTS

| | | | |
|---|---|---|---|
| 2,914,170 | 11/1959 | Kent | 72/257 |
| 3,267,711 | 8/1966 | Anderson | 72/256 |
| 3,587,280 | 6/1971 | Engelhardt et al. | 72/257 |
| 3,739,619 | 6/1973 | Follrath et al. | 72/257 |

*Primary Examiner*—Lowell A. Larson

*Attorney, Agent, or Firm*—Paul & Paul

[57] ABSTRACT

An extruded materials conveying apparatus for an extruding press intended for use with a stretcher, comprising a number of beams on the side of the stretcher, said beams being reciprocally movable and inclinable in a direction perpendicular to the axis of the stretcher, and driving means for each beam comprising a rack and a pinion, each pinion being rotatably connected to a common shaft through a clutch means provided with a lever mechanism for controlling the clutch means between the latter and the stretcher, said lever mechanisms being operated by the tail stock of the stretcher.

7 Claims, 10 Drawing Figures

APPARATUS FOR CONVEYING PRODUCTS EXTRUDED OUT OF AN EXTRUDING PRESS

DISCLOSURE OF THE INVENTION

This invention relates to an apparatus for conveying extruded materials or products out of and into a stretcher which is one of the pieces of equipment position downstream from an extruding press to perform operations subsequent to the press work.

There is known a conveying apparatus comprising a stretcher in which the extruded materials are held between a head stock and a tail stock, and can be stretched by the operation of the head stock. In such a known apparatus, the position in which the head stock is secured must be adjusted or changed in accordance with the predetermined length of the extruded product. The part of the extruded product conveying apparatus positioned between the head stock and the tail stock has to be able to project up to the axial centre portion of the stretcher. Further, in the portion of the tail stock opposite the head stock, there must be the capability to retract the unnecessary portions of the conveying apparatus out of the axial centre of the stretcher so as not to obstruct the operation. Also in the known extruded product conveying apparatus, there are provided, at the sides of the stretcher, a plurality of rocking beams oriented to a direction perpendicular to the axial direction of the stretcher. Each of these rocking beam is provided with one sliding beam which can reciprocally move in a direction perpendicular to the axial direction of the stretcher. However, projection of a number of necessary sliding beams out of the rocking beams and retraction of a number of unnecessary sliding beams into the rocking beams is, when necessary, accomplished manually by an operator or operators. In addition, in order to secure to the rocking beams the sliding beams which are projected out of or retracted into the rocking beams, an operator manually inserts and takes out fixing pins between the sliding beams and the rocking beams. This manual operation decreases the working efficiency of the apparatus and also presents a danger to the operator.

The main object of the present invention is to eliminate the above mentioned drawbacks. To achieve the object, there is provided a conveying apparatus for extruded materials or products wherein the sliding beams can be automatically projected and retracted by the displacement of the tail stock of the stretcher, thereby to increase the working efficiency of the apparatus and to reduce the manual labor required.

According to the invention, there is provided an apparatus for conveying products extruded out of an extruding press intended for use with a stretcher which is positioned downstream from the extruding press for operations subsequent to the extrusion, comprising a number of beams provided on the side of the stretcher, said beams being reciprocally movable and being inclinable in a direction perpendicular to the axis of the stretcher, and driving means for each of said beams comprising a rack and a pinion, said pinions being rotatably connected to a common rotatable shaft by way of clutch means provided with lever mechanisms arranged between the latter and the side of the stretcher for controlling the clutch means, said lever mechanisms being operated by the displacement of the stretcher to operate the corresponding clutch means.

Preferably, said apparatus comprises a frame on which said stretcher moves to stretch and reform the products, said frame being provided with a number of stoppers spaced from one another any one of which can engage and hold the stretcher in position in accordance with a predetermined length of the products which are to be stretched and reformed.

Preferably, said a number of beams comprises sliding beams which are engaged with the racks to reciprocally move therewith between their protrusion positions in which they protrude upto the stretcher portion and their retraction positions in which they retract out of the stretcher, said beams being engaged with the pinions rotatably connected to the common rotatable shaft by way of the clutch means, and rocking beams on which said sliding beams are slidably provided and which swing with the help of lever mechanisms operated by cylinders to cause a rocking motion of the sliding beams thereon.

According to the invention, each of said clutch means comprises a sliding portion and a rotating portion, said sliding portion being rotatable with and slidable on the common rotatable shaft with the help of a sliding key to engage and disengage the rotating portion, and accordingly to transmit and not to transmit the rotation of the shaft or the sliding portion to the rotating portion, said rotating portion being connected to the pinion through a key, each of said clutch means being provided with a lever mechanism comprising a lever assembly, one end of which is connected to the sliding portion of the clutch means to slide the sliding portion and the other end of which is provided with two rollers which can be alternately struck by a striker fixed to the stretcher to bring the clutch means into its operational position and non-operational position.

In the detailed description of the preferred embodiment of the invention presented below, reference is made to the accompanying drawings, in which.

Figure 1:
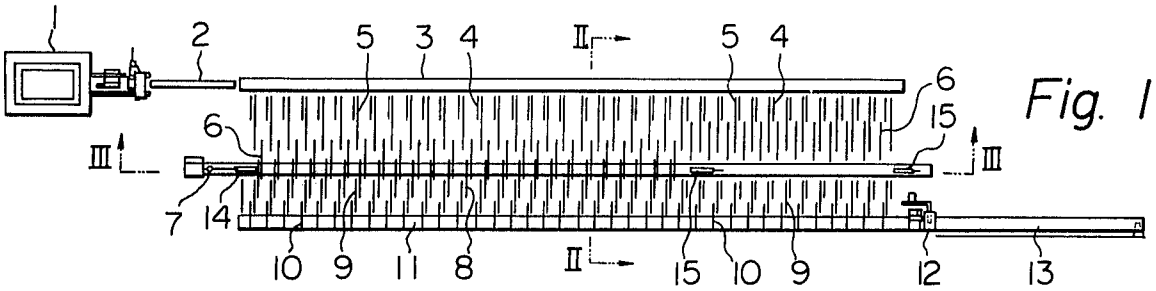
FIG. 1 is a plan view of the entire arrangement of equipments arranged in the rear of the extruding press.
Figure 2:
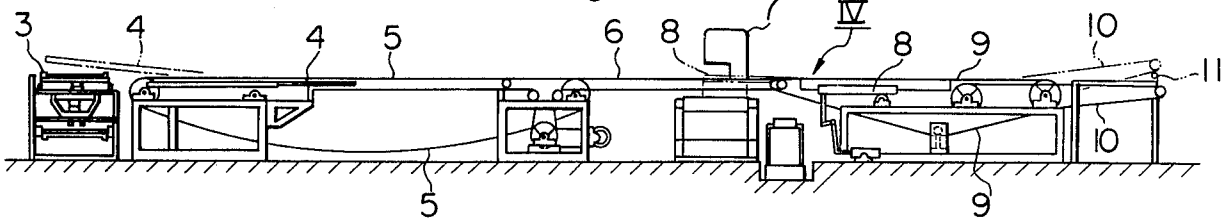
FIG. 2 is an enlarged sectional view taken along the line II—II in FIG. 1.

In FIGS. 1 and 2, 1 shows an extruding press, 2 an initial table, 3 a run out table, 4 lift transfers and 5 cooling tables, 6 first transfer conveyers, 7 a stretcher, 8 a stretcher pick off apparatus, i.e. and extruded materials conveying apparatus according to the present invention; 9 storage tables, 10 second transfer conveyers, 11 a saw charge table, 12 a cutting saw and 13 a saw gauge table.

A material extruded from the extruding press 1 presses over the initial table 2 and is conveyed to the run out table 3. The run out table 3 orients the extruded material in a direction perpendicular to the extruding direction and conveys it onto the cooling tables 5 with the help of the lift transfers 4 which occupy a position shown by a two dot-dash line in FIG. 2. During the time the cooling tables 5 convey the material thereon to the first transfer conveyers 6, the material is cooled. The cooled material is, then, conveyed by the operation of the first transfer conveyers 6 to the stretcher 7, in which the material is held, stretched and reformed between a head stock 14 and a tail stock 15 of the stretcher 7.

Figure 3:
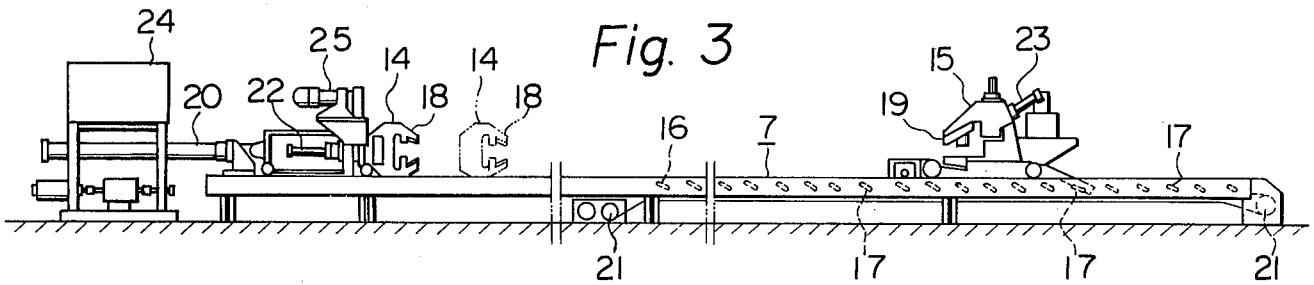
FIG. 3 is an enlarged sectional view taken along the line III—III in FIG. 1.

The stretcher 7 comprises the head stock 14 slidable on a frame 16 in tensioning and untensioning directions, within a relatively small distance, and the tail stock 15, which is movable on the frame 16 in the tensioning and untensioning directions, with a relatively larger distance, but is immovable on the frame 16 due to stoppers 17 (FIG. 3) when the material is stretched and reformed. The tail stock 15 is provided with a cutter not shown for cutting the extruded materials. The frame 16 is provided with a number of stoppers 17, which are spaced from each other, a proper stopper 17 being engaged with a portion of the tail stock 15 to cause the tail stock to be immovable on the frame 16. The immovable position of the tail stock 15 on the frame 16 depends on the predetermined length of the extruded material to be stretch reformed. After the opposite ends of the extruded material are clamped by a chuck device 18 of the head stock 14, occupying a position shown by a two dot-dashed line in FIG. 3, and by a chuck device 19 of the tail stock 15, the head stock 14 is retracted by means of a cylinder 20 to stretch the extruded material. Thus, the material is stretch-reformed and is straightened.

In the drawings, the reference numeral 21 shows a drive means for moving the tail stock 15, the numerals 22, 23 are cylinders for operating the chuck devices 18 and 19, respectively, the numeral 24 is a oil pressure unit and the numeral 25 is motor means for rotating the chuck device 18.

After stretch-reformation by the stretcher 7, the reformed material is released out of the head stock 14 and the tail stock 15, and is transported onto the storage tables 9 by the operation of the stretcher pick off apparatus 8. The material is, then, conveyed by the second transfer conveyers 10 onto the saw charge table 11, wherein the material is conveyed in a longitudinal direction thereof onto the saw gauge table 13 on which a standard size of the material is cut by the operation of the cutting saw 12. The standard size material or product is then, conveyed out by, for example, a conveyer (not shown) to be loaded on pallets.

The stretcher 7 which is one of the equipments arranged in the rear of the extruding press is provided, at its one side, with the stretcher pick off apparatus comprising a number of beams 26 (FIG. 5) which are movable to and from and inclinable in a direction perpendicular to the axis of the stretcher 7.

Figure 4:
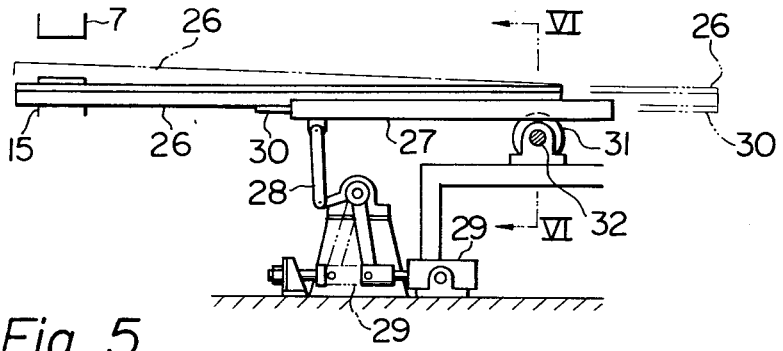
FIG. 4 is an enlarged view of the part indicated by the letter "IV" in FIG. 2.

The stretcher pick off apparatus 8 shown in FIG. 4 comprises a number of rocking or swing beams 27, which are slidable up and down, to which the beams 26 are attached so as to be slidable in the axial direction thereof. The up and down rocking motion of the beams 27 is assured by the operation of a cylinder 29 through a lever mechanism 28 and the to and fro reciprocating motion of the beams 26 is assured by the operation of a rack 30 and a pinion 31 provided on each of the beams 26. In FIG. 4, a solid line shows a beam 26 which is in a horizontal position and which is in a forward position in which the beam 26 projects up to the stretcher 7, and; a two dot-dashed line on the left shows a beam 26 in an upward position in which the product on the stretcher 7 can be moved to the right with the retraction of the beam 26. On the other hand, a two dot-dashed line on the right in FIG. 4 shows a beam 26 in a retracted position in which the beam 26 does not prevent the displacement of the tail stock 15.

Figure 6:
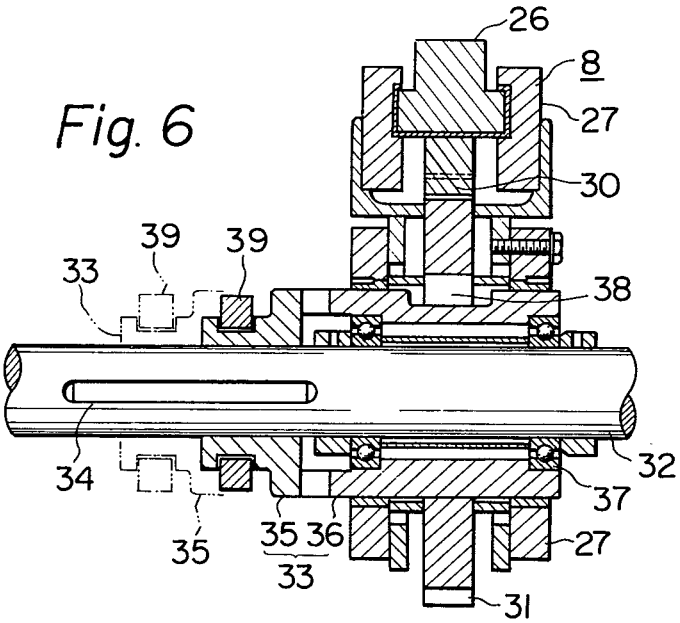
FIG. 6 is a sectional view taken along the line VI—VI in FIG. 4.

Each pinion 31 for beams 26 is rotatably mounted to a common rotatable shaft 32 through a clutch means 33, as shown in FIG. 6. The common shaft 32 can be rotated by proper drive means, for example, a motor (not shown). In FIG. 6, on the shaft 32, a sliding portion 35 of the clutch means 33 is provided and is slidable in the axial direction with the help of a sliding key 34. A rotating portion 36 of the clutch means 33 is rotatably provided by way of a bearing 37, said rotating portion 36 being connected to the pinion 31 by way of a key 38. The rotating motion of the shaft 32 is transmitted to the pinion 31 when the sliding portion 35 (FIG. 6) of the clutch means 33 is engaged with the rotating portion 36 thereof during the rotation of the shaft 32, as shown by a solid line in FIG. 6. On the other hand, the transmition of the rotating motion of the shaft 32 to the pinion 33 is broken when the clutch means 33 is released or disengaged. The clutch means 33 is operated by a lever 39.

Figure 5:
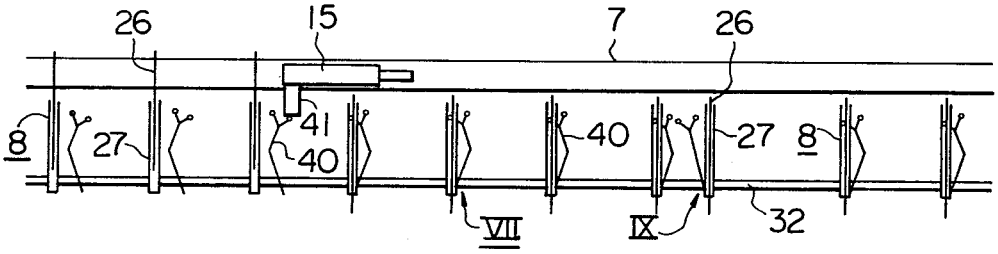
FIG. 5 is an enlarged partial view of FIG. 1.

When the shaft 32 is rotated with the clutch means 33 engaged, the beam 26 goes forward to the stretcher 7, but the beam 26 is kept in its retracted position so long as the clutch means is disengaged released (FIG. 5). That is, in FIG. 5 the beams 26 in the left of the tail stock 15 are in their forward positions and the beams 26 in the right of the tail stock 15 are in their retracted positions. The reverse rotation of the shaft 32 may cause the beams in their forward positions to be retracted. In order to automatically protrude and retract the beams 26, in accordance with the position of the tail stock 15, there is provided a lever mechanism 40 for opening and closing each clutch means 33, between each clutch means 33 and the side of the stretcher 7. Said lever mechanism 40 is operated by the displacement of the tail stock 15 of the stretcher 7 to open and close the clutch means 33. To the tail stock 15 is secured a striker 41 which operates the clutch means 33.

The lever mechanisms 40 are usually arranged on the right of the beams 27, but can be, if impossible to arrange them on the right because of a positional relationship to any other devices such as driving devices or connecting devices which are also arranged on the same side of the beams 27, arranged on the left of the beams 27, one example of which is shown in a portion indicated by IX in FIG. 5.

Figure 7:
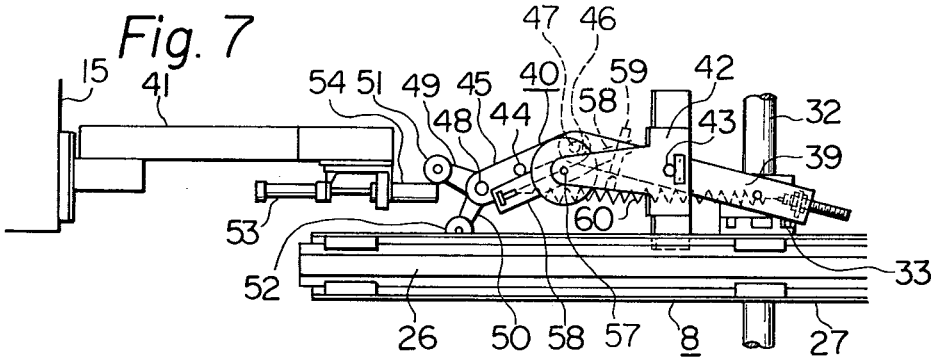
FIG. 7 is an enlarged view of the part indicated by the letter "VII" in FIG. 5.

The lever mechanism 40 is shown in detail in FIGS. 7 to 10. In the lever mechanism 40 shown in FIGS. 7 and 8, the reference numeral 42 designates a fixing frame and numerals 43 and 44 designate pivot shafts. The centre portion of the lever 39 is rotatably mounted on the shaft 43 and the centre portion of the lever 45 is rotatably mounted on the shaft 44. One end of the lever 39 is fitted in a corresponding recess formed in the sliding portion 35 (FIG. 6) of the clutch means 33 to enable the sliding portion 35 to slide on the rotatable shaft 32. The other end of the lever 39 is rotatably connected to one end of the lever 45 with the help of a pin 47 inserted in a slot 46. To the other end of the lever 45, two levers 49 and 50 are mounted, through a stationary shaft 48, in the form of V. The levers 49 and 50 are provided, at their free ends, with rollers 51 and 52, respectively. When the clutch means 33 is engaged, i.e. in operation, the levers 49 and 50 form a reversed V in which the portion of the pin 47 generally positioned at the centre of the levers protrudes upward as shown in FIG. 7. In FIG. 7, when the tail stock 15 moves upward in the drawing, resulting in the upward displacement of the roller 51 by the free end 54 of the piston rod of the cylinder 53 attached to the striker 41, the levers 49 and 50 form a letter V so that the clutch means 33 is released. The striker 41 is, in addition, provided with a cylinder 55 (FIG. 8) parallel to the cylinder 53, and the free end 56 (FIG. 8) of the piston rod of the former cylinder can move the roller 52 downward in FIG. 7. To a portion of the stationary frame 42 provided on the fixed shaft 43, a centre portion of a lever 58 is rotatably mounted through a pin 57. The lever 39 is provided with a roller 59 with a U-shaped groove in which one end of the lever 58 is inserted so as to rotate the lever 58 about the pin 57 by the operation of the lever 39. A tension spring 60 is provided between the other end of the lever 58 and the end of the lever 39 opposite to the pin 47. The provision of the lever 58 and the tension spring 60 ensures that the levers 39 and 45 are kept in the form of a reversed V.

Figure 8:
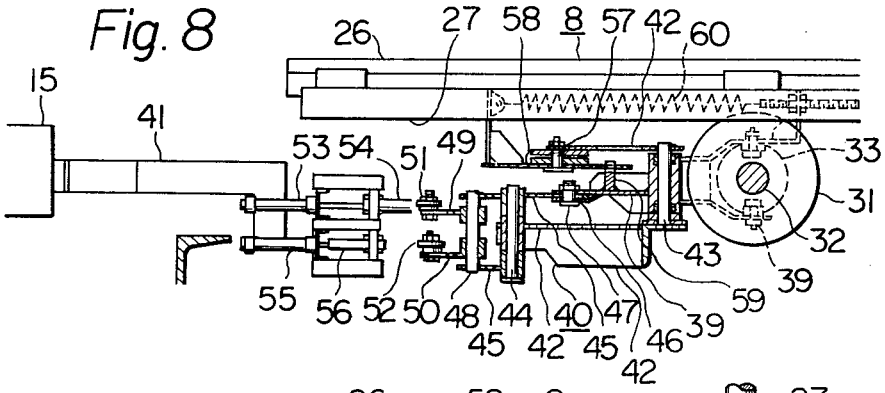
FIG. 8 is a partially sectioned elevational view of FIG. 7.
Figure 9:
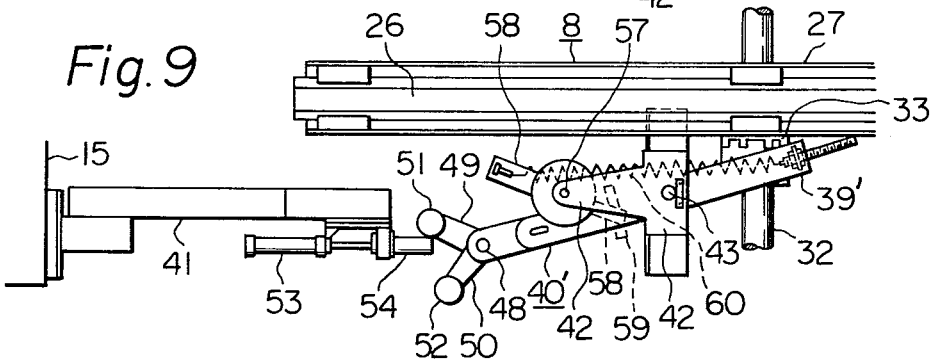
FIG. 9 is an enlarged view of the part indicated by the letter "IX" in FIG. 5.
Figure 10:
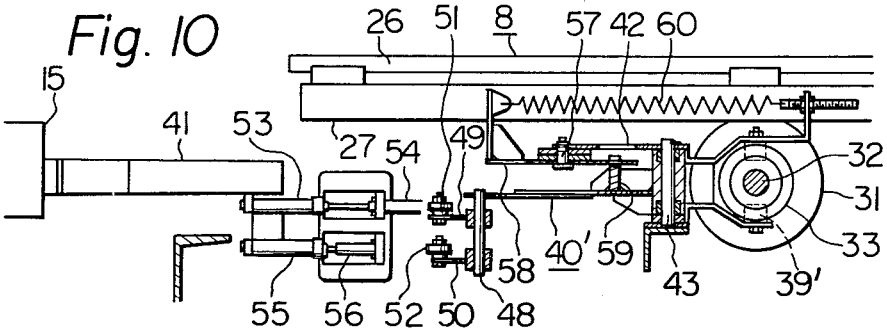
FIG. 10 is a partially sectioned elevational view of FIG. 9.

The lever mechanism 40' shown in FIGS. 9 and 10 is essentially similar to that of FIGS. 7 and 8, but the lever 39' in FIGS. 9 and 10 is constructed as a straight single member unlike the lever assembly 39 in FIGS. 7 and 8 which consists of two levers 39 and 45 pivotally connected to each other in the form of V. This difference in the construction of the lever mechanism is derived from the lever mechanism being arranged on the left or right of the beams 26 (beams 27). Also in FIGS. 9 and 10, the clutch means 33 is operated by the displacement of the striker 41. That is, in FIG. 9, when the striker 41 moves upward in the drawing, the free end 54 of the piston rod of the cylinder 53 strikes the roller 51, resulting in release of the clutch means 33. On the other hand, when the striker 41 moves downward in FIG. 9, the free end 56 (FIG. 10) of the piston rod of the cylinder 55 (FIG. 10) strikes the roller 52, resulting in engagement of the clutch means 33. Parts and components in FIGS. 9 and 10 corresponding to parts and components in FIGS. 7 and 8 are shown by the same numerals as in FIGS. 7 and 8, and explanations thereof are omitted.

As is apparent from the above explanation, according to the invention, the protrusion and retraction of a number of beams in the extruded material conveying apparatus provided on the side of the stretcher can be automatically effected by the displacement of the tail stock of the stretcher. Further, the sliding beams between the head stock and the tail stock of the stretcher can automatically move to the stretcher portion and the sliding beams in the rear of the tail stock can be retracted so as not to obstruct the movement of the tail stock. Thus, the present invention increases the working efficiency of the apparatus, and contributes to safe operation of the apparatus as well as savings in manual labor.

What we claim is:

1. An apparatus for conveying products extruded out of an extruding press intended for use with a stretcher which is positioned downstream from the extruding press for operations subsequent to the extrusion, comprising a number of beams provided on the side of the stretcher, said beams being reciprocally movable and being inclinable in a direction perpendicular to the axis of the stretcher, and driving means for each of said beams comprising a rack and a pinion, said pinions being rotatably connected to a common rotatable shaft by way of clutch means provided with lever mechanisms arranged between the latter and the side of the stretcher for controlling the clutch means, said lever mechanisms being operated by the displacement of the stretcher to operate the corresponding clutch means.

2. An apparatus as set forth in claim 1, wherein said apparatus comprises a frame on which said stretcher moves to stretch and reform the products, said frame being provided with a number of stoppers spaced from one another any one of which can engage and hold the stretcher in position in accordance with a predetermined length of the products which are to be stretched and reformed.

3. An apparatus as set forth in claim 1, wherein said a number of beams comprises sliding beams which are engaged with the racks to reciprocally move therewith between their protrusion positions in which they protrude upto the stretcher portion and their retraction positions in which they retract out of the stretcher, said beams being engaged with the pinions rotatably connected to the common rotatable shaft by way of the clutch means, and rocking beams on which said sliding beams are slidably provided and which swing with the help of lever mechanisms operated by cylinders to cause a rocking motion of the sliding beams thereon.

4. An apparatus as set forth in claim 3, wherein each of said clutch means comprises a sliding portion and a rotating portion, said sliding portion being rotatable with and slidable on the common rotatable shaft with the help of a sliding key to engage and disengage the rotating portion, and accordingly to transmit and not to transmit the rotation of the shaft or the sliding portion to the rotating portion, said rotating portion being connected to the pinion through a key, each of said clutch means being provided with a lever mechanism comprising a lever assembly, one end of which is connected to the sliding portion of the clutch means to slide the sliding portion and the other end of which is provided with two rollers which can be alternately struck by a striker fixed to the stretcher to bring the clutch means into its operational positioned and non-operational position.

5. An apparatus for conveying products extruded out of an extruding press intended for use with a stretcher which is positioned downstream from the extruding press for operations subsequent to the extrusion, comprising a number of beams provided on a side of the stretcher, said beams being reciprocally movable and being includable in a direction perpendicular to the axis of said stretcher, and driving means for each of said beams comprising a rack and pinion, said pinion being rotatably connected to a common rotatable shaft by way of clutch means operably connected to a lever mechanism positioned between said clutch means and said side of said stretcher for controlling the operation of said clutch means, said lever mechanism comprising a lever assembly including at least one lever having one end operably connected to said clutch means and another end operably associated with and positioned adjacent a striker movably mounted to said side of said stretcher whereby movement of said striker will impart a corresponding movement to said lever assembly and said clutch means thereby controlling said driving means.

6. An apparatus as set forth in claim 5 wherein said other end of said lever comprises a pair of levers having one end mounted to said lever and extending therefrom said pair of levers forming a generally V-like shape.

7. An apparatus as set forth in claim 6 wherein the other end of said pair of levers contain rollers thereon, one of said rollers positioned adjacent and above said striker and another roller positioned adjacent and below said striker.

* * * * *